US011255155B2

(12) United States Patent
Yuan et al.

(10) Patent No.: US 11,255,155 B2
(45) Date of Patent: Feb. 22, 2022

(54) DOWNHOLE APPARATUS WITH REMOVABLE PLUGS

(71) Applicant: Halliburton Energy Services, Inc., Houston, TX (US)

(72) Inventors: Min Mark Yuan, Katy, TX (US); Frank Vinicio Acosta, Spring, TX (US); Lonnie Helms, Humble, TX (US); Rajesh Parameshwaraiah, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 2 days.

(21) Appl. No.: 16/647,770

(22) PCT Filed: May 9, 2019

(86) PCT No.: PCT/US2019/031541
§ 371 (c)(1),
(2) Date: Mar. 16, 2020

(87) PCT Pub. No.: WO2020/226655
PCT Pub. Date: Nov. 12, 2020

(65) Prior Publication Data

US 2021/0230970 A1 Jul. 29, 2021

(51) Int. Cl.
*E21B 34/06* (2006.01)
*E21B 43/10* (2006.01)

(52) U.S. Cl.
CPC ..... *E21B 34/063* (2013.01); *E21B 43/10* (2013.01); *E21B 2200/08* (2020.05)

(58) Field of Classification Search
CPC ..... E21B 34/063; E21B 43/10; E21B 2200/08
See application file for complete search history.

(56) References Cited

U.S. PATENT DOCUMENTS

| | | | |
|---|---|---|---|
| 3,463,351 | A | 8/1969 | Mills |
| 3,779,263 | A | 12/1973 | Edwards et al. |
| 3,980,134 | A | 9/1976 | Amancharla |
| 4,457,376 | A | 7/1984 | Carmody et al. |

(Continued)

FOREIGN PATENT DOCUMENTS

| | | | |
|---|---|---|---|
| EP | 0566290 | A1 | 10/1993 |
| EP | 0681087 | B1 | 9/2000 |

(Continued)

OTHER PUBLICATIONS

International Search Report and Written Opinion dated Feb. 5, 2020, issued in corresponding PCT Application No. PCT/US2019/031541.

(Continued)

*Primary Examiner* — Christopher J Sebesta
(74) *Attorney, Agent, or Firm* — McAfee & Taft

(57) ABSTRACT

A downhole tool includes a casing string with a fluid barrier connected therein defining a lower end of a buoyancy chamber. A plug assembly connected in the casing string defines an upper end of the buoyancy chamber. The plug assembly has an outer case with a rupture disc positioned therein configured to block flow and to burst at a predetermined pressure. The rupture disk is removable from a flow path through the outer case upon the flow of fluid therethrough.

15 Claims, 8 Drawing Sheets

(56) References Cited

U.S. PATENT DOCUMENTS

| | | | | |
|---|---|---|---|---|
| 5,150,756 | A | 9/1992 | Hassanzadeh | |
| 5,479,986 | A * | 1/1996 | Gano | E21B 23/00 166/292 |
| 5,765,641 | A | 6/1998 | Shy et al. | |
| 5,826,661 | A | 10/1998 | Parker et al. | |
| 6,026,903 | A | 2/2000 | Shy et al. | |
| 6,076,600 | A | 6/2000 | Vick, Jr. et al. | |
| 6,161,622 | A | 12/2000 | Robb et al. | |
| 6,324,904 | B1 | 12/2001 | Ishikawa et al. | |
| 6,450,263 | B1 | 9/2002 | Schwendemann | |
| 6,505,685 | B1 | 1/2003 | Sullaway et al. | |
| 6,622,798 | B1 | 9/2003 | Rogers et al. | |
| 6,651,748 | B2 | 11/2003 | Sullaway et al. | |
| 6,672,389 | B1 | 1/2004 | Hinrichs | |
| 6,758,281 | B2 | 7/2004 | Sullaway et al. | |
| 7,270,191 | B2 | 9/2007 | Drummond et al. | |
| 8,505,621 | B2 | 8/2013 | Telfer et al. | |
| 9,033,055 | B2 | 5/2015 | McCoy et al. | |
| 9,309,752 | B2 | 4/2016 | Talley et al. | |
| 9,441,437 | B2 | 9/2016 | Fripp et al. | |
| 9,441,446 | B2 | 9/2016 | Fripp et al. | |
| 9,518,445 | B2 | 12/2016 | Noske | |
| 9,540,904 | B2 | 1/2017 | Petrowsky | |
| 9,593,542 | B2 | 3/2017 | Getzlaf et al. | |
| 10,138,707 | B2 | 11/2018 | Tolman et al. | |
| 10,323,478 | B2 | 6/2019 | Berscheidt et al. | |
| 2002/0185273 | A1 | 12/2002 | Aronstam et al. | |
| 2003/0116324 | A1 | 6/2003 | Dawson et al. | |
| 2003/0217844 | A1 | 11/2003 | Moyes | |
| 2008/0073075 | A1 | 3/2008 | Buyers et al. | |
| 2008/0115942 | A1 | 5/2008 | Keller et al. | |
| 2010/0270031 | A1 | 10/2010 | Patel | |
| 2010/0294376 | A1 | 11/2010 | O'Brien et al. | |
| 2011/0042099 | A1 | 2/2011 | Williamson, Jr. et al. | |
| 2011/0253392 | A1 | 10/2011 | May et al. | |
| 2012/0111566 | A1 | 5/2012 | Sherman et al. | |
| 2014/0174757 | A1 * | 6/2014 | Fripp | E21B 29/02 166/376 |
| 2014/0216756 | A1 | 8/2014 | Getzlaf et al. | |
| 2014/0224505 | A1 | 8/2014 | Ramon | |
| 2014/0338923 | A1 | 11/2014 | Fripp et al. | |
| 2015/0068730 | A1 * | 3/2015 | Frazier | E21B 34/063 166/181 |
| 2015/0107843 | A1 | 4/2015 | Talley et al. | |
| 2015/0129205 | A1 | 5/2015 | Hofman et al. | |
| 2015/0240596 | A1 | 8/2015 | Horwell | |
| 2016/0177668 | A1 | 6/2016 | Watson et al. | |
| 2016/0333658 | A1 * | 11/2016 | Keshishian | E21B 33/126 |
| 2017/0022783 | A1 * | 1/2017 | Yong | H04L 41/0266 |
| 2017/0096875 | A1 | 4/2017 | Ravensbergen et al. | |
| 2017/0138153 | A1 | 5/2017 | Getzlaf et al. | |
| 2018/0003004 | A1 | 1/2018 | Norman et al. | |
| 2018/0058179 | A1 | 3/2018 | Nuryaningsih et al. | |
| 2018/0080308 | A1 | 3/2018 | Dedman et al. | |
| 2018/0135394 | A1 * | 5/2018 | Tolman | E21B 34/063 |
| 2018/0219200 | A1 | 8/2018 | Albukrek et al. | |
| 2018/0262127 | A1 | 9/2018 | Gooneratne et al. | |
| 2018/0371869 | A1 | 12/2018 | Kellner et al. | |
| 2019/0128081 | A1 | 5/2019 | Ross et al. | |
| 2019/0352994 | A1 | 11/2019 | Giroux | |
| 2019/0352995 | A1 | 11/2019 | Giroux et al. | |

FOREIGN PATENT DOCUMENTS

| | | | |
|---|---|---|---|
| JP | 6551001 | B2 | 7/2019 |
| WO | 2014098903 | A1 | 6/2014 |
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Jul. 21, 2020, issued in PCT Application No. PCT/US2019/059864.
International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.
International Search Report and Written Opinion dated Oct. 27, 2020, issued in PCT Application No. PCT/US2020/039399.
International Search Report and Written Opinion dated Feb. 24, 2021, issued in PCT Application No. PCT/US2020/040157.
International Search Report and Written Opinion dated Aug. 14, 2018, issued in PCT Application No. PCT/US2017/062528.
International Search Report and Written Opinion dated Sep. 19, 2019, issued in PCT Application No. PCT/US2018/066889.
International Search Report and Written Opinion dated Sep. 19, 2019, issued in PCT Application No. PCT/US2018/067161.
International Search Report and Written Opinion dated Aug. 14, 2019, issued in PCT Application No. PCT/US2019/064051.
International Search Report and Written Opinion dated Jan. 14, 2020, issued in PCT Application No. PCT/US2019/027502.
International Search Report and Written Opinion dated Jan. 16, 2020, issued in PCT Application No. PCT/US2019/027625.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated May 26, 2020, issued in PCT Application No. PCT/US2019/059757.

* cited by examiner

DOWNHOLE APPARATUS WITH REMOVABLE PLUGS

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

BRIEF DESCRIPTION OF THE DRAWINGS

FIG. 6 is a cross section of the embodiment of FIG. 2 after the plug therein has been removed.

DESCRIPTION

Figure 1:
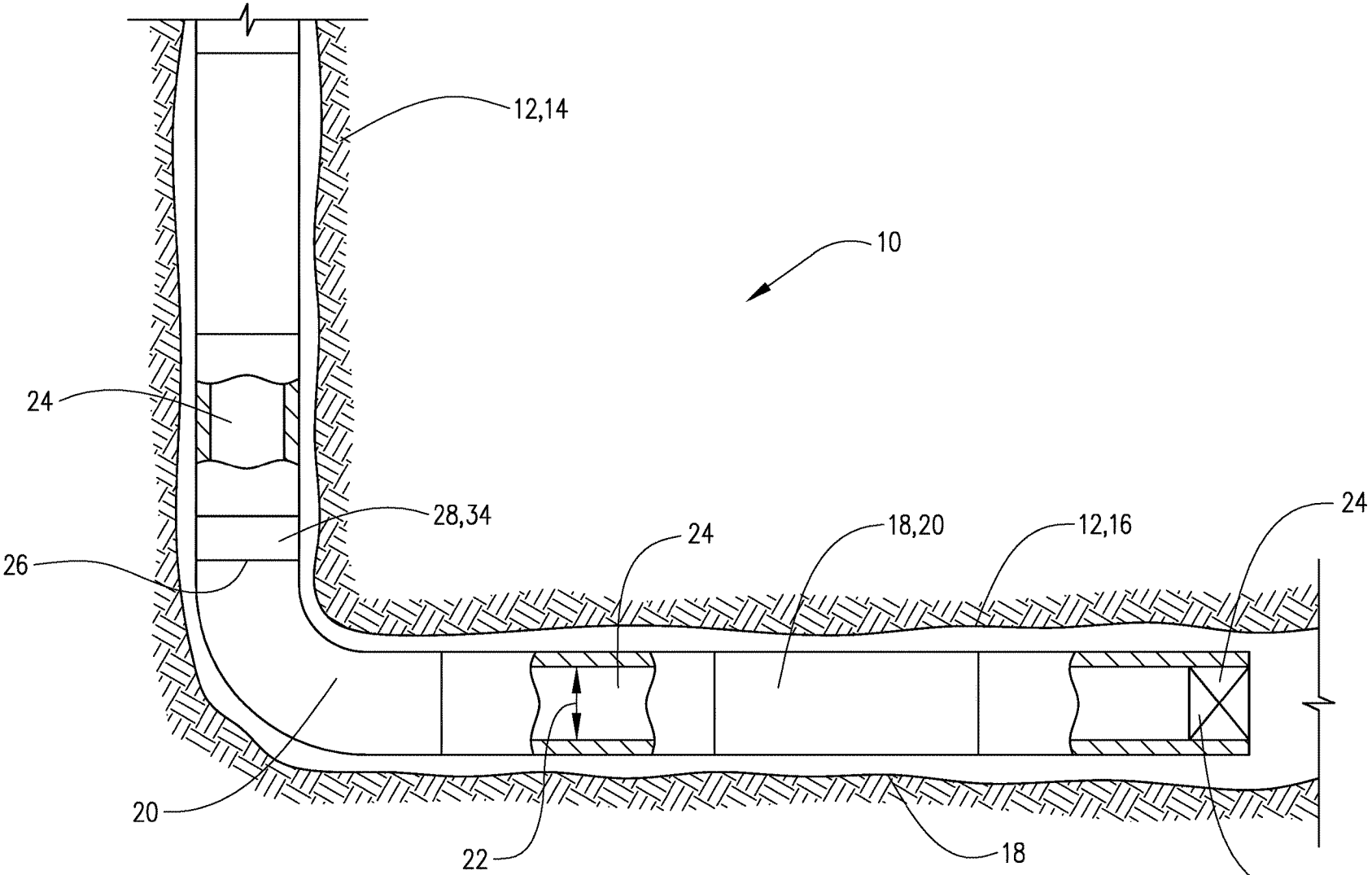
FIG. 1 is a schematic view of an exemplary well bore with a well casing including a buoyancy chamber therein.
Figure 2:
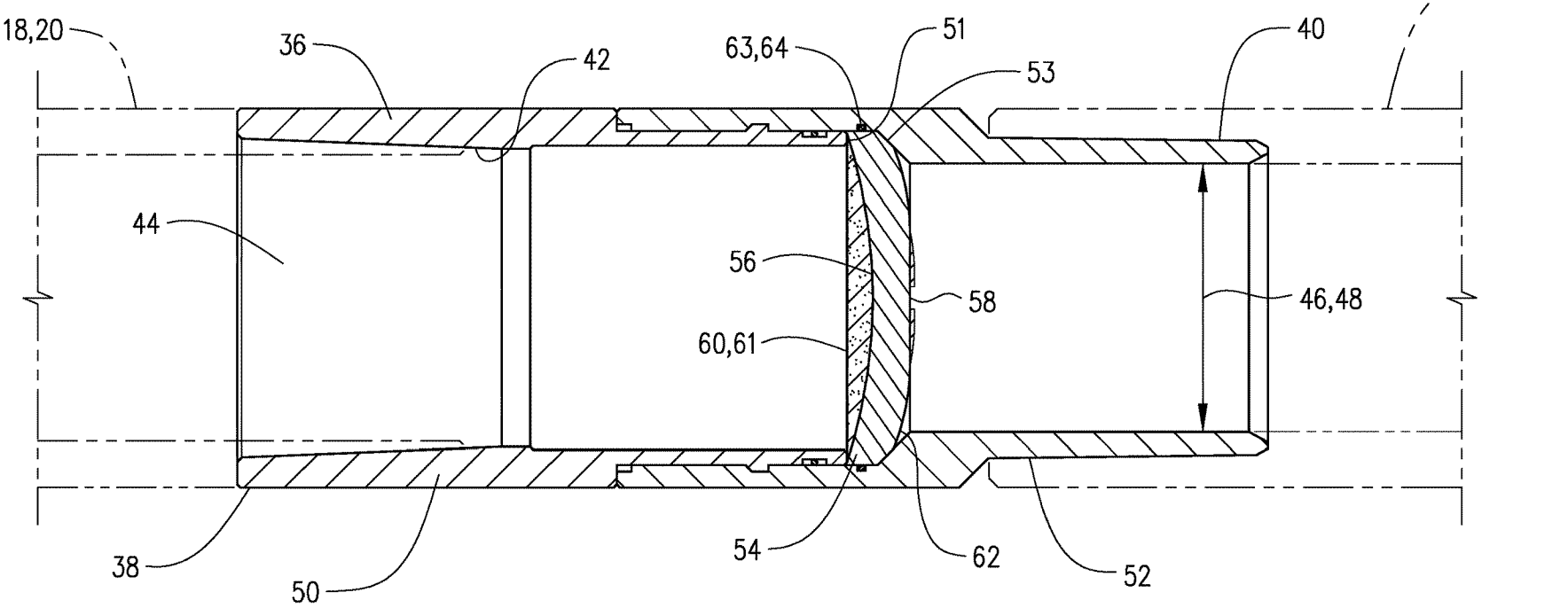
FIG. 2 is a cross section of a downhole apparatus of the current disclosure.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these are used is a factor of the well conditions and the amount of buoyancy desired.

Lower boundary 30 may comprise a float device such as a float shoe or float collar. As is known, such float devices will generally allow fluid flow downwardly therethrough but will prevent flow upwardly into the casing. The float devices are generally a one-way check valve. The float device 30 will be configured such that it will hold the buoyant fluid in the buoyancy chamber 26 until additional pressure is applied after the release of the buoyancy fluid from the buoyancy chamber.

The upper boundary 28 is defined by a buoyancy assist tool 34. Buoyancy assist tool 34 comprises an outer case 36 with upper and lower ends 38 and 40 connected to casing joints 20 thereabove and therebelow. Thus, outer case 36 defines a portion of casing string 18. Outer case 36 has an inner surface 42 defining a flow path 44 therethrough.

Buoyancy assist 34 likewise defines an inner diameter 46 which may include a minimum inner diameter 48. Outer case 36 comprises an upper outer case 50 connected by threading or other means to a lower outer case 52. Upper outer case 50 has lower end 51. An upward facing shoulder 53 is defined on the inner surface 42. A rupture disk 54 is disposed in the outer case 36 and is positioned to block flow therethrough and to prevent flow from casing string 18 from passing therethrough into buoyancy chamber 26 until a predetermined pressure is reached. In the described embodiment the rupture disk 54 is trapped between lower end 51 of upper outer case 50 and upward facing shoulder 53 defined on lower outer case 52.

Rupture disk 54 has upper surface 56 and lower surface 58. Rupture disk 54 may have an arcuate shape, and may be for example concave. Rupture disk 54 may include surface coverings 60 which may comprise a first or upper surface covering 61 and a second or lower surface covering 62 on upper and lower surfaces 56 and 58 respectively. Upper and lower surface coverings 61 and 62 may be a sealant or a coating that is impermeable or will otherwise prevent fluids in the outer case 36 from contacting the rupture disk 54 until a predetermined pressure at which the rupture disk 54 will rupture is reached. Once the predetermined pressure is reached, rupture disk 54 will rupture and fluid flowing through outer case 36 will degrade the rupture disk 54 and will degrade and/or pull the surface coverings 61 and 62 through the outer case 36 such that an open flow path 44 with no restrictions exists. Lower outer case 52 may have a groove 63 with O-ring 64 therein to sealingly engage the periphery of rupture disk 54.

Rupture disk 54 may be comprised of materials that are readily dissolvable or degradable when exposed to a degrading fluid, such as an aqueous fluid. The degradable rupture disk 54 may be comprised of a degradable material, which may be, for example, a degradable metallic material that is degradable with a degrading fluid, for example an aqueous fluid. The dissolvable or degradable materials for rupture disk 54 may be for example, in a non-limiting fashion, one or more of aluminum, magnesium, aluminum-magnesium alloy, iron and alloys thereof, degradable polymers, or any combinations thereof. Non-limiting examples of degrading fluids include, for example fresh water, salt water, brine, seawater, cement and water based mud.

In operation casing string 18 with buoyancy chamber 26 and buoyancy assist tool 34, which is the upper end or upper boundary of buoyancy chamber 26, is lowered in the well bore to the desired location. Running a casing such as casing string 18 in deviated wells and along horizontal wells often results in significantly increased drag forces and may cause a casing string to become stuck before reaching the desired location in the well bore. For example, when the casing string 18 produces more drag forces than any available weight to slide the casing string 18 down the well the casing string may become stuck. If too much force is applied damage may occur to the casing string. The buoyancy assist tool 34 described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into well bore 12 buoyancy chamber 26 will aid in the proper placement since it will reduce friction as the casing 18 is lowered into the horizontal portion 16 to the desired location.

Once the desired depth is reached in well bore 12, fluid pressure in casing string 18 is increased to a predetermined pressure at which the rupture disk 54 ruptures. After rupture disk 54 ruptures fluid passing downward through casing 18 will begin to dissolve, or degrade rupture disk 54 such that there is an open bore or flow path 44 through buoyancy assist tool 34. No other equipment or medium is used to remove the rupture disk 54, which is removed solely by fluid flowing through outer case 36. Upper and lower surface coverings 61 and 62 will likewise dissolve or degrade, or be rendered into small pieces by the flow of fluid through outer case 36 and will not create any restriction in the flow path 44. The buoyancy assist tool 34 thus provides no greater restriction than the minimum diameter of the casing which may be for example identical to or slightly smaller than minimum inner diameter 48. In any event buoyancy assist tool 34 defines the upper boundary of buoyancy chamber 26, and provides no restriction on the size of tools that can pass therethrough that did not already exist as a result of the inner diameter of the casing string.

Figure 3:
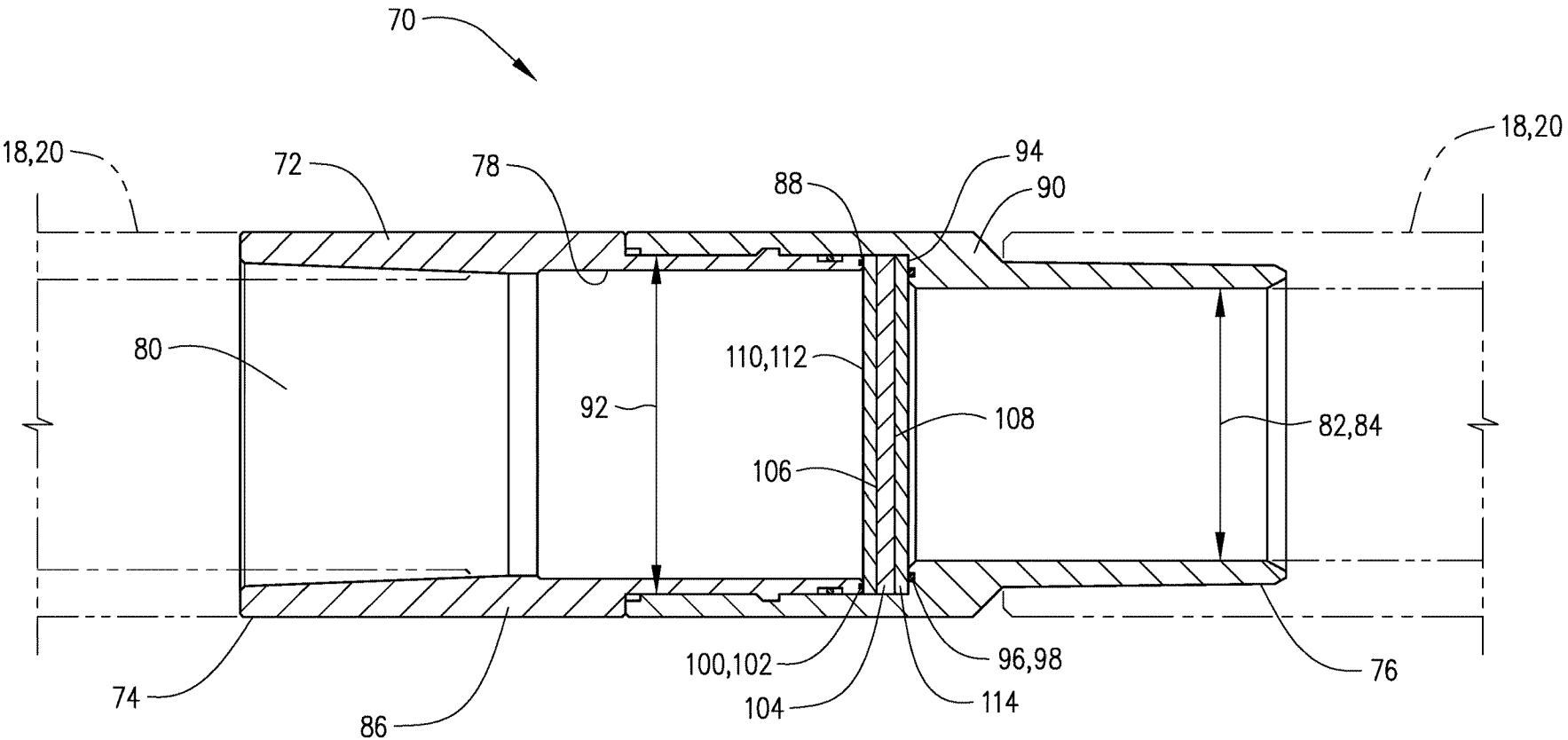
FIG. 3 is a cross section of an additional embodiment of a downhole apparatus.

In an additional embodiment in FIG. 3 a buoyancy assist tool 70 may be connected in casing string 18 and comprise the upper end 28 of buoyancy chamber 26. Buoyancy assist tool 70 comprises an outer case 72 with upper end 74 and lower end 76. Outer case 70 is identical in many respects to outer case 36. Outer case 72 has inner surface 78 defining a flow path 80 therethrough. Inner surface 78 defines inner diameter 82 which may include minimum inner diameter 84.

Outer case 72 comprises an upper outer case 86 with a lower end 88. A lower outer case 90 is connected by threading or other means as known in the art to upper outer case 86. Outer case 72 has a second inner diameter 92. An upward facing shoulder 94 is defined by and between second inner diameter 92 and first or minimum diameter 84. Upward facing shoulder 94 has a groove 96 with an O-ring 98 positioned therein. Lower end 88 of upper outer case 86 likewise has a groove 100 with an O-ring 102 therein.

Buoyancy assist tool 70 includes a rupture disk 104 with upper surface 106 and lower surface 108. Rupture disk 104 is positioned between and held in place by shoulder 94 and lower end 88 of upper outer case 86. A surface covering 110 which may comprise an upper surface covering 112 and a lower surface covering 114 cover the upper and lower surfaces 106 and 108 of rupture disk 104. Upper and lower surface coverings 112 and 114 will prevent fluid from contacting rupture disk 104 until the predetermined pressure at which rupture disk 104 will rupture is reached. Rupture disk 104 is a dissolvable or degradable rupture disk.

In the embodiment of FIG. 3 upper and lower surface coverings 112 and 114 are comprised of a frangible material, such as for example tempered glass. O-rings 98 and 102 will sealingly engage upper and lower surface coverings 112 and 114 respectively. Rupture disk 104 may be comprised of materials that are readily dissolvable or degradable when exposed to a degrading fluid, such as an aqueous fluid. The degradable rupture disk 104 may be comprised of a degradable material, for example, a degradable metallic material that is degradable with a degrading fluid, for example an aqueous fluid. The dissolvable or degradable materials for rupture disk 104 may be for example, in a non-limiting fashion, one or more of aluminum, magnesium, aluminum-magnesium alloy, iron and alloys thereof, degradable polymers, or any combinations thereof. Non-limiting examples of degrading fluids include, for example fresh water, salt water, brine, seawater, cement and water based mud.

Once the desired depth is reached in well bore 12, fluid pressure in casing string 18 is increased to a predetermined pressure at which the rupture disk 104 ruptures. After rupture disk 104 ruptures fluid passing downward through casing 18 will begin to dissolve, or degrade rupture disk 104 such that there is an open bore or flow path 80 through buoyancy assist tool 70. No other equipment or medium is used to remove the rupture disk 104, which is removed solely by fluid flowing through outer case 72. Upper and lower frangible surface coverings 112 and 114 will break into small pieces and will pass through outer case 72 and will not provide a restriction to flow therethrough. The pieces of surface coverings 112 and 114 will be flushed out solely with fluid passing through outer case 72. In any event in the embodiment of FIG. 3 buoyancy assist tool 70 defines the upper boundary of buoyancy chamber 26, and provides no restriction on the size of tools that can pass therethrough that did not already exist as a result of the inner diameter of the casing string.

Figure 4:
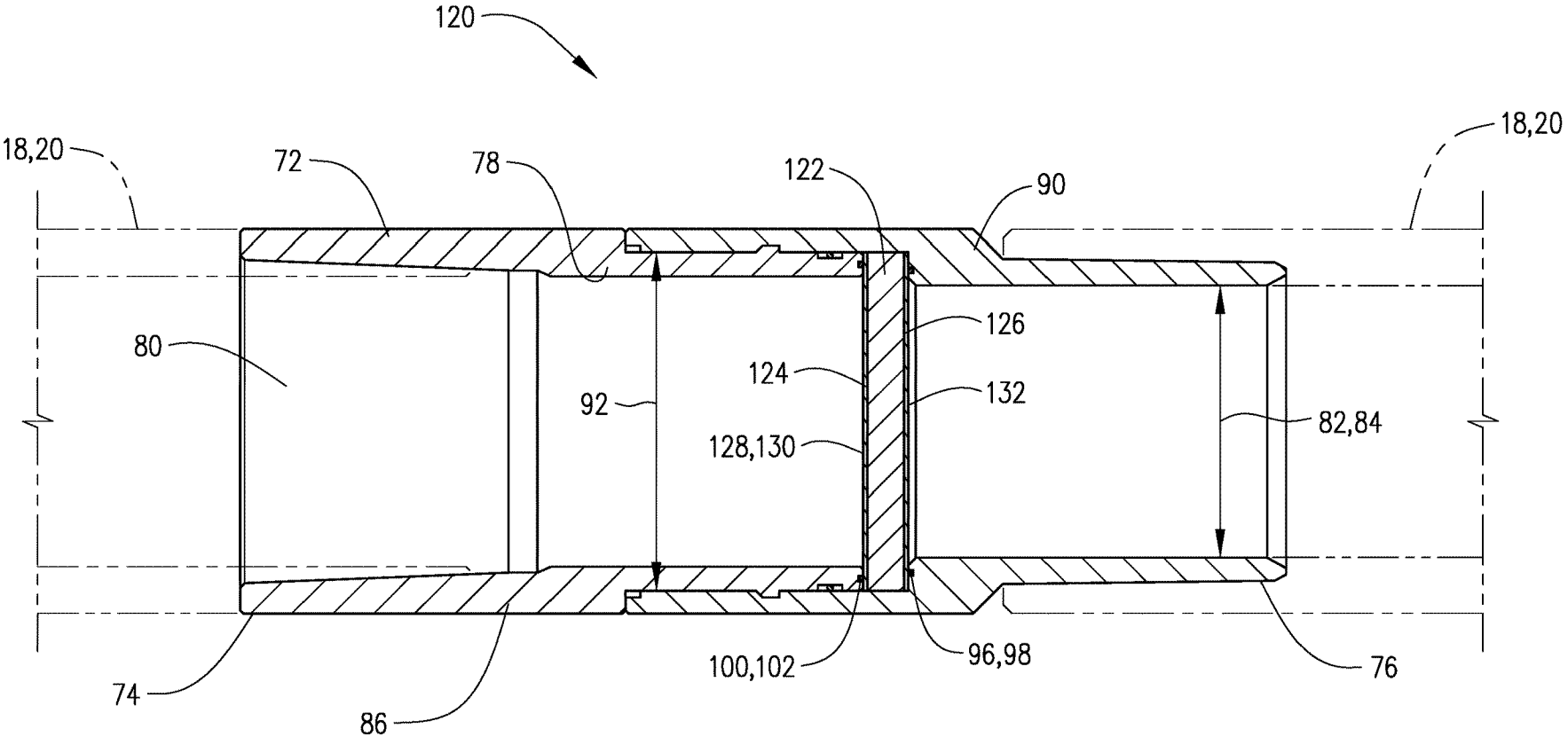
FIG. 4 is cross section of another alternative embodiment of a downhole apparatus.

An additional embodiment of a buoyancy assist tool 120 is shown in FIG. 4. Buoyancy assist tool 120 has outer case 72 as previously described. Buoyancy assist tool 120 includes a rupture disk 122 with upper surface 124 and lower surface 126. Rupture disk 122 is positioned between and held in place by shoulder 94 and lower end 88 of upper outer case 86. Surface coverings 128 which may include an upper surface covering 130 and a lower surface covering 132 cover the upper and lower surfaces of rupture disk 122 to prevent fluid passing through outer case 72 from contacting rupture disk 122 prior to reaching the predetermined pressure at which disk 122 ruptures. Upper and lower surface coverings 130 and 132 in the embodiment of FIG. 4 may comprise a coating or sealant which may be for example selected from the group consisting of alkali aluminosilicate glass, polyethylene terephthalate (PET) and thermoplastic polyurethane (TPU).

Rupture disk 122 is comprised of a degradable material, which may be, in a non-limiting example, a degradable metallic material. The degradable rupture disk 122 may be comprised of a degradable material, which may be, for example, a degradable metallic material that is degradable with a degrading fluid, for example an aqueous fluid. The dissolvable or degradable materials for rupture disk 122 may be for example, one or more of aluminum, magnesium, aluminum-magnesium alloy, iron and alloys thereof, degradable polymers, or any combinations thereof. Non-limiting examples of degrading fluids include, for example fresh water, salt water, brine, seawater, cement and water based mud.

Once the desired depth is reached in well bore 12, fluid pressure in casing string 18 is increased to a predetermined pressure at which the rupture disk 122 ruptures. After rupture disk 122 ruptures fluid passing downward through casing 18 will begin to dissolve, or degrade rupture disk 122 such that there is an open bore or flow path 80 through buoyancy assist tool 120. No other equipment or medium is used to remove the rupture disk 122, which is removed solely by fluid flowing through outer case 72. Upper and lower surface coverings 130 and 132 will dissolve or degrade, or may be torn or rendered into small pieces that pass through outer case 72 solely as a result of fluid passing therethrough and will not provide a restriction to flow through flow path 80. In any event in the embodiment of FIG. 4 buoyancy assist tool 120 defines the upper boundary of buoyancy chamber 26, and provides no restriction on the size of tools that can pass therethrough that did not already exist as a result of the inner diameter of the casing string 18.

Figure 5:
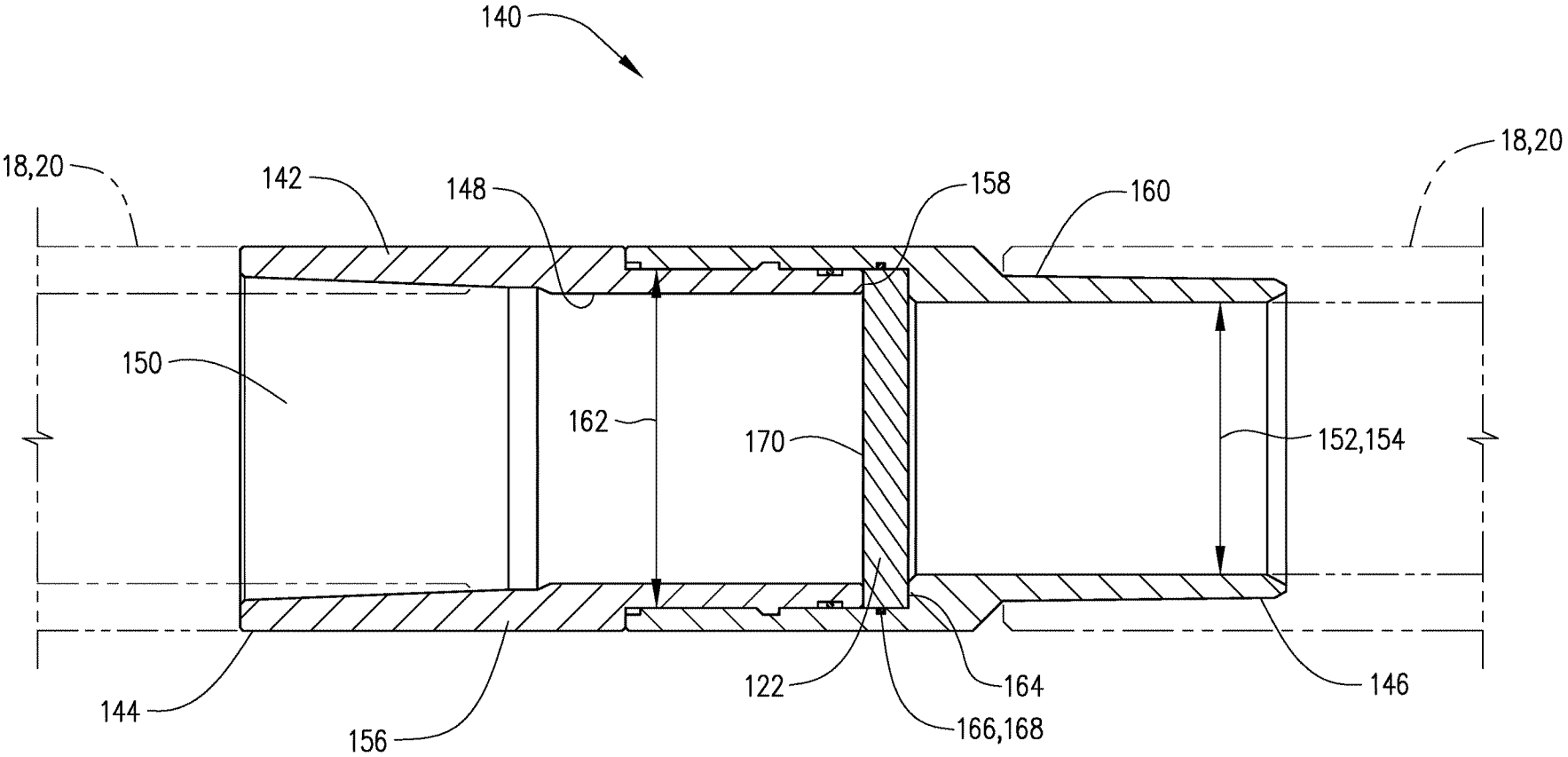
FIG. 5 is a cross section of another alternative embodiment of a downhole apparatus.
Figure 5:
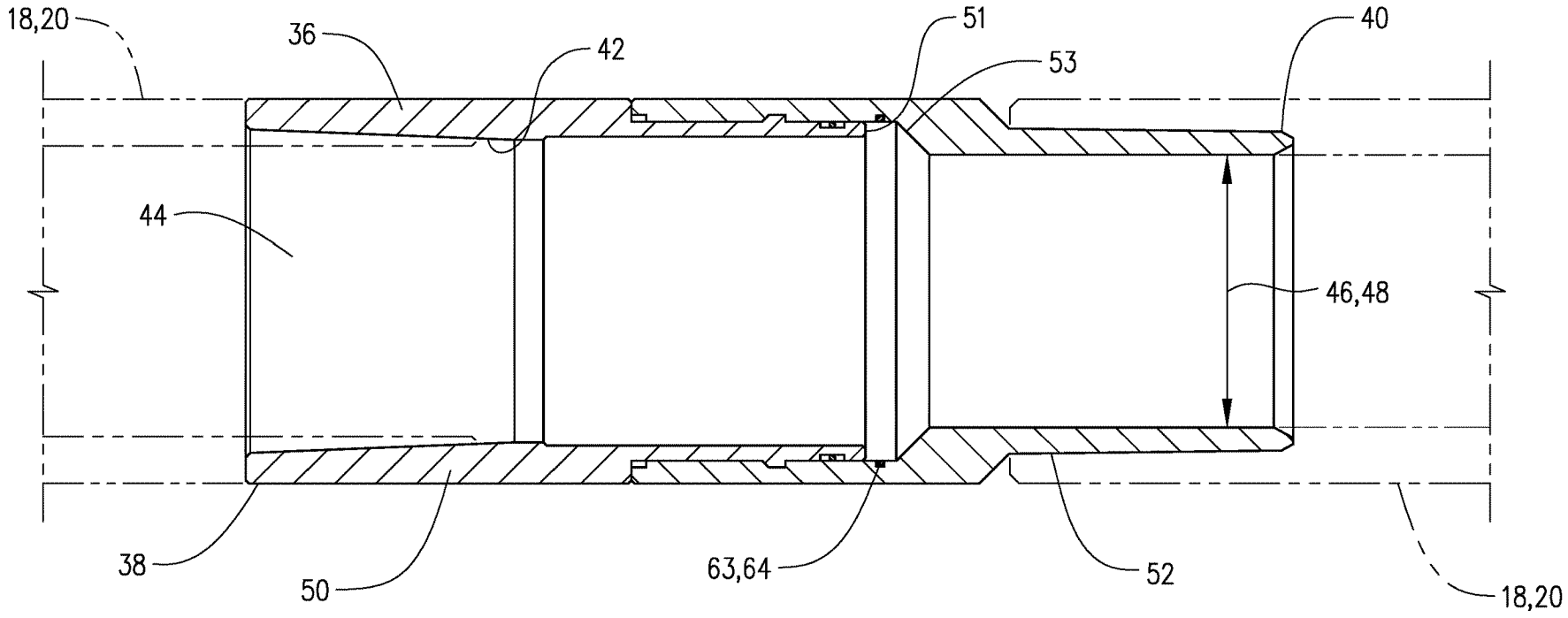
Figure 7:
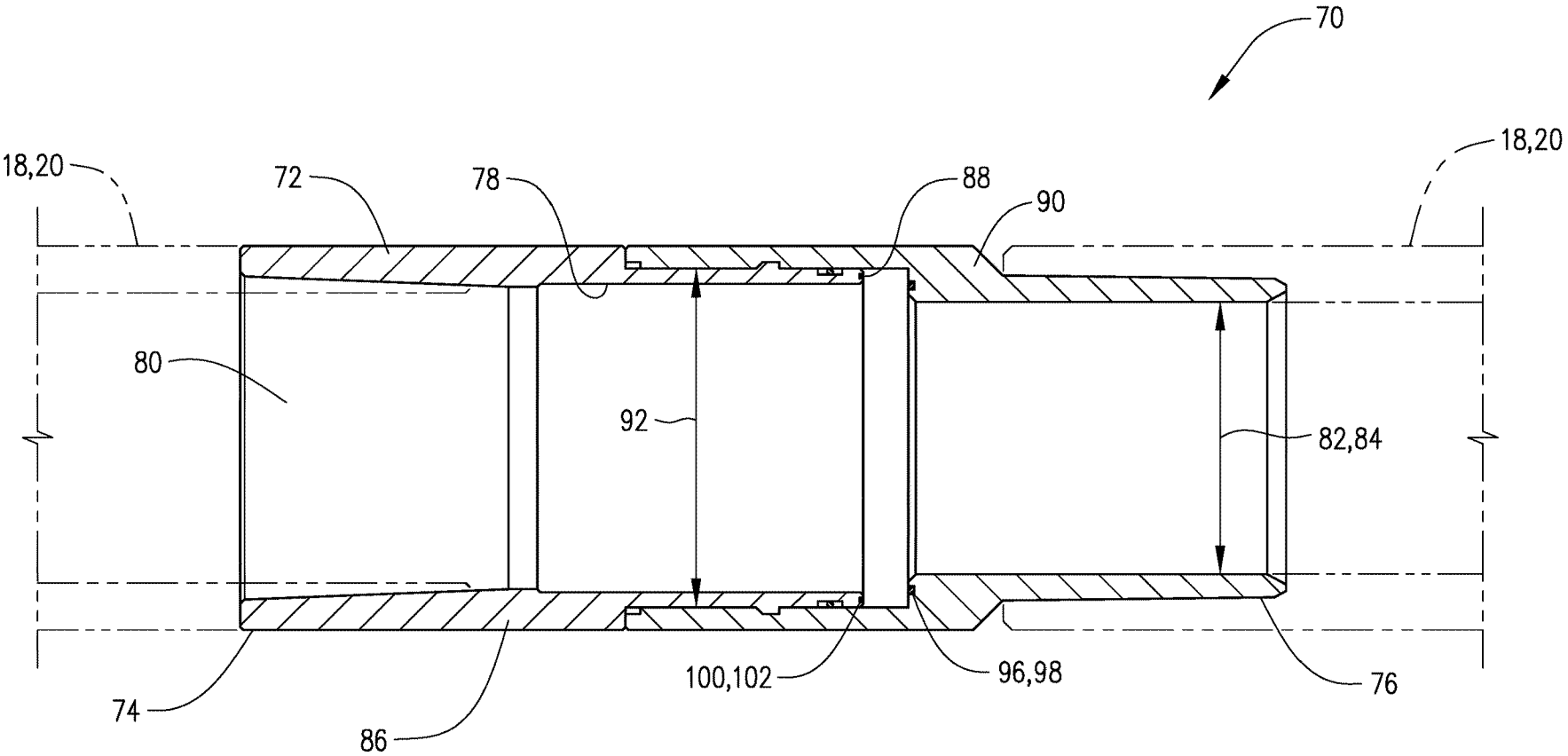
FIG. 7 is a cross section of the embodiment of FIGS. 3 and 4 after the plug therein has been removed.
Figure 8:
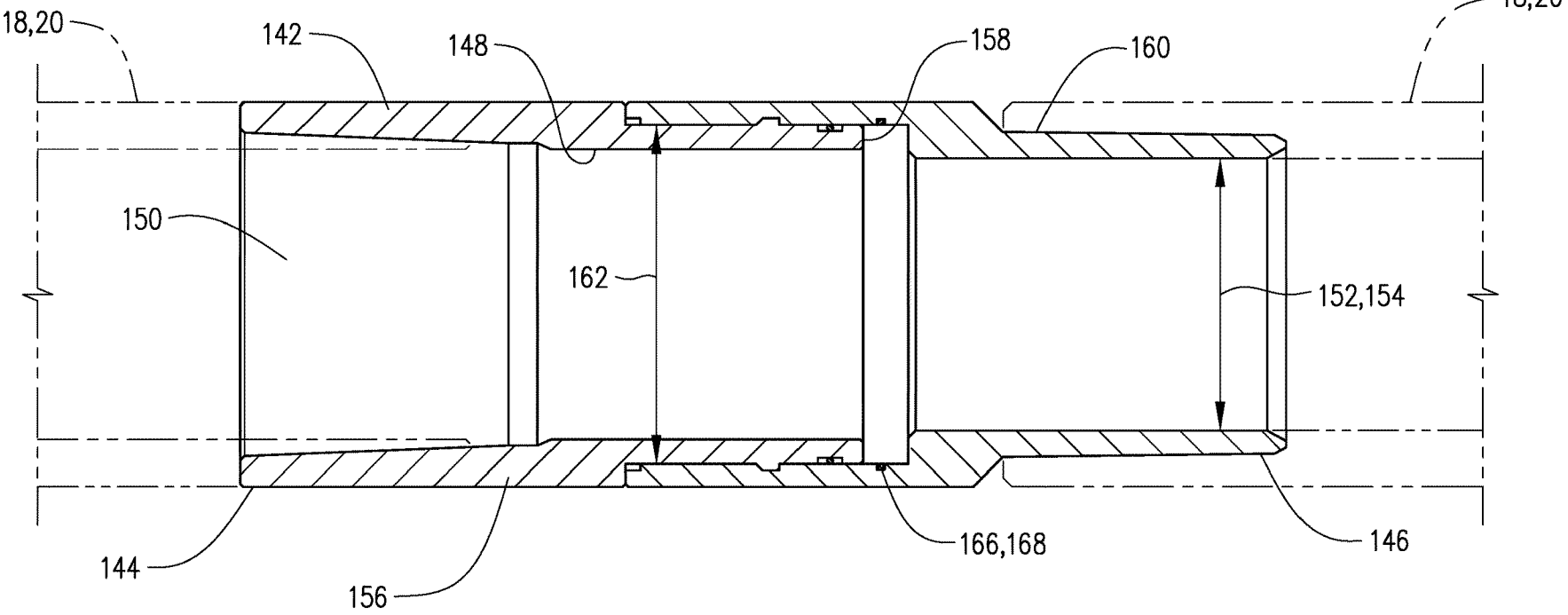
FIG. 8 is a cross section of the embodiment of FIG. 5 after the plug therein has been removed.

An additional embodiment of a buoyancy assist tool 140 is shown in FIG. 5. Buoyancy assist tool 140 is identical in many respects to the prior described embodiment but is slightly different in the configuration of the outer case and in the rupture disk material. Buoyancy assist tool 140 has outer case 142 with upper end 144 and lower end 146 connected in casing string 18. Outer case 142 has inner surface 148 defining a flow path 150 therethrough. Inner surface 148 defines inner diameter 152 which may include a minimum inner diameter 154. Outer case 142 comprises an upper outer case 156 with a lower end 158 connected to a lower outer case 160. Upper and lower outer cases 158 and 160 may be threadedly connected or connected to one another by other means known in the art. Outer case 142 defines a second inner diameter 162. An upward facing shoulder 164 is defined by and between minimum inner diameter 154 and second diameter 162. Outer case 142 has groove 166 with O-ring 168.

A rupture disk 170 is positioned in outer case 142 and blocks flow therethrough until a predetermined pressure is reached. Rupture disk 170 is held in place by lower end 158 of upper outer case 156 and shoulder 164. Rupture disk 170 is sealingly engaged by O-ring 168. In the embodiment of FIG. 5 disk 170 may be a tempered glass or other frangible material such that upon reaching the rupture disk 170 will shatter into pieces that will pass through outer case 142 and casing string 18. The rupture disk 170 will shatter such that no sharp edges will remain and outer case 142 will have an open flow path 150 therethrough with minimum diameter 154.

Once the desired depth is reached in well bore 12, fluid pressure in casing string 18 is increased to a predetermined pressure at which the rupture disk 170 ruptures. After rupture disk 170 ruptures fluid passing downward through casing 18 will flush the broken pieces of rupture disk 170 from outer case 142 such that there is an open flow path 150 through buoyancy assist tool 140. The broken pieces will be flushed from flow path 150 solely with fluid passing therethrough. In any event in the embodiment of FIG. 5 buoyancy assist tool 120 defines the upper boundary of buoyancy chamber 26, and provides no restriction on the size of tools that can pass therethrough that did not already exist as a result of the inner diameter of the casing string 18.

A downhole tool comprises a casing string with a fluid barrier connected therein defining a lower end of a buoyancy chamber. A plug assembly connected in the casing string defines an upper end of the buoyancy chamber. The plug assembly comprises an outer case connected in the casing string and a rupture disk positioned in the outer case configured to block flow therethrough. The rupture disk is configured to burst at a predetermined pressure. The rupture disk is completely removable from a flow path through the outer case solely upon the flow of fluid therethrough.

In one embodiment the rupture disk is a degradable rupture disk. The degradable disk has a surface covering on an upper surface thereof and in one embodiment has a surface covering on upper and lower surfaces of the rupture disk. The upper and lower surface coverings may comprise tempered glass or non-permeable coatings or sealant. In an additional embodiment the rupture disk may comprise a frangible material that will break into pieces and leave an open flow path through the outer case, such as for example tempered glass.

A method of lowering a casing string into a well bore comprises placing a fluid barrier in the casing string and positioning a plug assembly in the casing string above the fluid barrier to define a buoyancy chamber in the casing string. In one embodiment the plug assembly comprises an outer case with a rupture disk therein. The method may further comprise lowering the casing string into the well bore and increasing the pressure in the casing string to burst the rupture disk. The method further comprises removing the rupture disk from a flow path through the outer case solely with fluid flowing through the casing string.

In an embodiment the removing step may comprise degrading the rupture disk with the fluid flowing through the outer case to completely remove the rupture disk from the flow path. In an additional embodiment the removing step comprises breaking the rupture disk into small fragments and removing the fragments from the flow path solely with fluid flowing through the outer case. The rupture disk may comprise tempered glass, or may comprise a degradable material.

Although the disclosed invention has been shown and described in detail with respect to a preferred embodiment, it will be understood by those skilled in the art that various changes in the form and detailed area may be made without departing from the spirit and scope of this invention as claimed. Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. A downhole tool comprising:

a casing string;

a fluid barrier connected in the casing string defining a lower end of a buoyancy chamber; and a plug assembly connected in the casing string and defining an upper end of the buoyancy chamber, the plug assembly comprising:

an outer case defining a central flow passage therethrough connected in the casing string; and a degradable rupture disk positioned in the outer case configured to block flow through the central flow passage and to rupture solely as a result of the application of fluid pressure to the rupture disk, the rupture disk being degraded by and completely removable from the central flow passage solely as a result of contact with a flow of a degrading fluid therethrough only after the degradable rupture disk has been ruptured.

2. The downhole tool of claim 1, further comprising a surface covering on an upper surface of the rupture disk.

3. The downhole tool of claim 1, further comprising a surface covering on upper and lower surfaces of the rupture disk.

4. The downhole tool of claim 3, the upper and lower surface coverings comprising tempered glass.

5. The downhole tool of claim 3, the upper and lower surface coverings comprising a non-permeable coating.

6. The downhole tool of claim 3, the upper and lower surface coverings comprising a frangible material that will break into pieces and leave an open flow path through the outer case.

7. A method of lowering a casing string into a well bore comprising:

placing a fluid barrier in the casing string;

positioning a plug assembly in the casing string above the fluid barrier to define a buoyancy chamber in the casing string, the plug assembly comprising an outer case with a degradable rupture disk therein;

lowering the casing string into the well bore;

increasing the pressure in the casing string to burst the rupture disk;

bursting the rupture disk solely by applying fluid pressure directly to the rupture disk to burst the rupture disk; and removing the rupture disk from a flow path through the outer case by degrading the rupture disk with a degrading fluid flowing through the casing string.

8. The method of claim 7, the removing step comprising degrading the rupture disk with the fluid flowing through the outer case to completely remove the rupture disk from the flow path.

9. The method of claim 7, the removing step comprising breaking the rupture disk into small fragments and removing the fragments from the flow path solely with fluid flowing through the outer case.

10. The method of claim 9, wherein the rupture disk is tempered glass.

11. The method of claim 7, the rupture disk having an impermeable surface covering on top and bottom surfaces thereof.

12. The method of claim 11, the impermeable surface covering comprising tempered glass.

13. A downhole tool comprising;

an outer case connectable at upper and lower ends to a casing string;

a degradable rupture disk positioned in the outer case to prevent flow through a central flow passage thereof until a predetermined pressure is reached, the rupture disk being ruptured solely as a result of the application of fluid pressure thereto and degradable as a result of contact with a degrading fluid flowing in the casing only after the degradable disk initially ruptures; and a surface covering on both of upper and lower surfaces of the rupture disk.

14. The downhole tool of claim 13, the surface coverings comprising a sealant.

15. The downhole tool of claim 13, the surface coverings comprising tempered glass.

* * * * *